United States Patent [19]

Happ et al.

[11] Patent Number: 4,771,668

[45] Date of Patent: Sep. 20, 1988

[54] CUTTING AN ELONGATED MEMBER INTO SECTIONS

[75] Inventors: Kenneth G. Happ, Cuyahoga Falls; Dennis A. Lundell, Uniontown; Richard B. Nash, Cuyahoga Falls, all of Ohio

[73] Assignee: The Goodyear Tire & Rubber Company, Akron, Ohio

[21] Appl. No.: 922,338

[22] Filed: Oct. 23, 1986

[51] Int. Cl.[4] ..... B26D 5/20

[52] U.S. Cl. ..... 83/354; 83/371; 83/578; 83/605

[58] Field of Search ..... 83/365, 371, 578, 605, 83/422, 354; 198/602, 604, 817

[56] References Cited

U.S. PATENT DOCUMENTS

| | | | |
|---|---|---|---|
| 2,719,941 | 10/1955 | Presenz | 83/578 |
| 3,100,414 | 8/1963 | Watkins et al. | 83/437 |
| 3,129,624 | 4/1964 | Auer | 83/300 |
| 3,356,205 | 12/1967 | McLeod | 198/817 |
| 3,922,937 | 12/1972 | Maddox | 83/365 |
| 3,969,054 | 7/1976 | Roane | 83/365 |
| 4,108,029 | 8/1978 | Borzym | 83/54 |
| 4,152,959 | 5/1979 | Elhaus | 83/123 |
| 4,267,752 | 5/1981 | Byrt | 83/365 |
| 4,398,439 | 8/1983 | Bryan | 83/422 |
| 4,437,372 | 3/1984 | Ishigami et al. | 83/320 |
| 4,442,741 | 4/1984 | Whittingham et al. | 83/578 |

*Primary Examiner*—Frederick R. Schmidt
*Assistant Examiner*—Blynn Shideler
*Attorney, Agent, or Firm*—Frederick K. Lacher; T. P. Lewandowski

[57] ABSTRACT

An elongated member (20) is fed by a feed conveyor (12) through a cutter (14) which is actuated to cut a first section (21). A takeaway conveyor (16) carries the first section (21) and a second section with a gap between the trailing end of the first section (21) and the leading end of the second section. Detection means (22) located along the takeaway conveyor (16) at a predetermined distance (L) from the cutter (14) actuates the cutter (14) in response to detection of the leading end of the second section providing a second section of a predetermined length (L). Other detection means (42,132) located at other positions along the conveyors (12,16) provide for stopping the apparatus (10) in the event of jamming or after the trailing end of the elongated member (20) reaches the feed conveyor (12).

12 Claims, 6 Drawing Sheets

CUTTING AN ELONGATED MEMBER INTO SECTIONS

This invention relates to measuring and cutting an elongated member. It is especially directed to a high speed hose cutter for cutting lengths of hydraulic hose into sections of a desired length. Heretofore measuring and cutting methods and apparatus have been provided for cutting an extruded rod at the extruder after a predetermined length has been extruded. Other cutting apparatus has been provided in which the cutters are moved with the material to be cut. These cutting methods and apparatus have not provided the cutting speed and accuracy required for high speed cutting of hydraulic hose where a cut length may be in the range of 4.7 inches (11.93 cm) to 77 inches (195.58 cm) with a tolerance of plus or minus 0.03 inches (0.076 cm) and with a line speed which is about 150 feet (45.72 m) per minute.

In accordance with one aspect of the invention there is provided a high speed measuring and cutting apparatus for cutting an elongated member to provide a cut section having a predetermined length comprising a feed conveyor, cutter means, cutter actuation means and a takeaway conveyor, means for driving the feed conveyor for feeding the elongated member through the cutter means, means for driving the takeaway conveyor to conveyor the elongated member away from the cutter means, means to provide a gap between the trailing end of a first section of the elongated member and the leading end of a second section of the elongated member, detection means spaced from the cutter means a distance equal to the predetermined length and the cutter actuation means being responsive to detection of movement of the leading end of the second section past the detection means for actuating the cutter means.

In accordance with another aspect of the invention there is provided a method of measuring and cutting an elongated member to provide a section having a predetermined length comprising:

(a) feeding the elongated member through a cutter means on a feed conveyor;

(b) actuating the cutting means to cut the first section off the elongated member;

(c) conveying the first section of the elongated member away from the cutter means on a takeaway conveyor with a gap between the trailing end of the first section and the leading end of a second section;

(d) detecting the leading end of the second section by detection means at a distance from the cutter means equal to the predetermined length; and (e) actuating the cutter means in response to the detection of movement of the leading end of the second section by the detection means to cut the second section to the predetermined length.

To acquaint persons skilled in the art most closely related to the present invention, a certain preferred embodiment thereof illustrating a best mode now contemplated for putting the invention into practice is described herein by and with reference to the annexed drawings forming a part of the specification. The embodiment shown and described herein is illustrative and as will become apparent to those skilled in these arts can be modified in numerous ways within the spirit and scope of the invention defined in the claims hereof.

Figure 1:
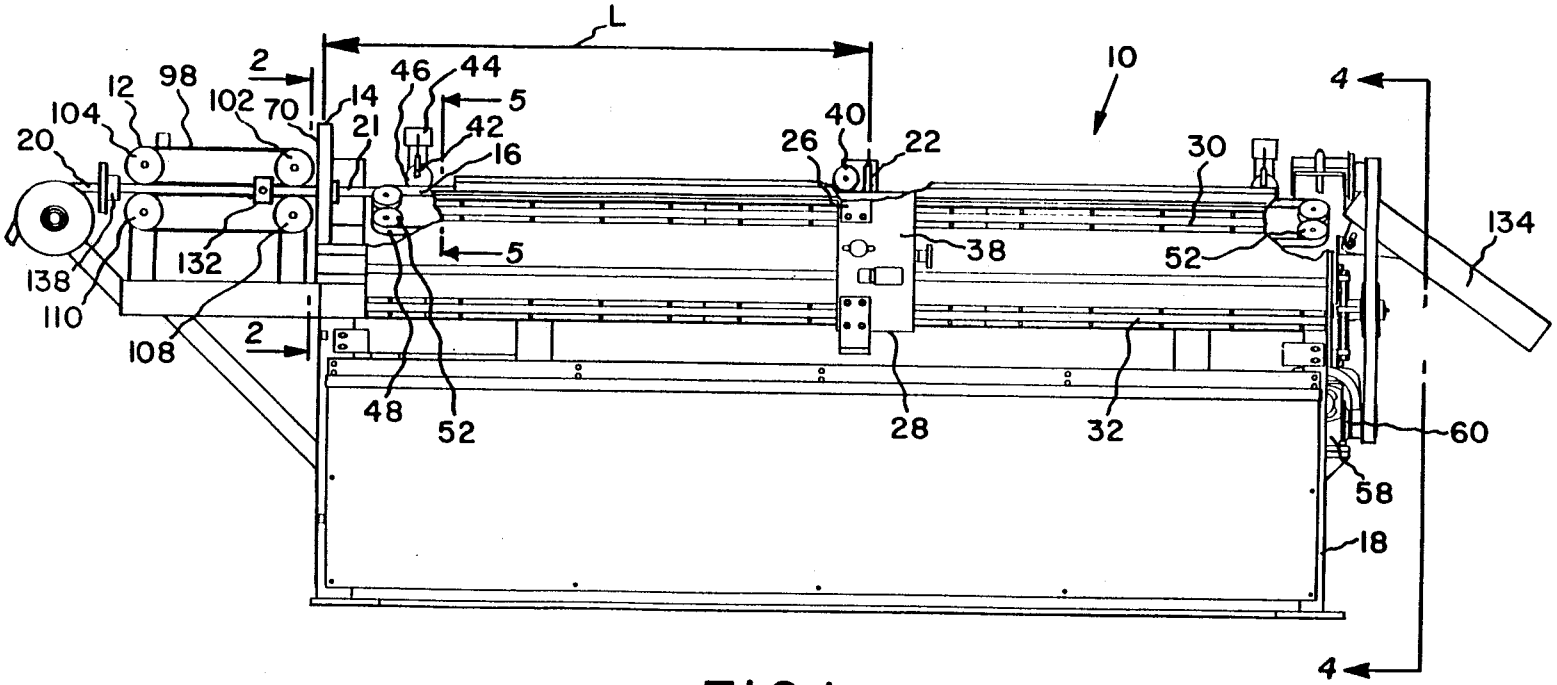
FIG. 1 is a schematic side elevation of the apparatus of this invention with parts being broken away to show the belt arrangement for the takeaway conveyor.

Referring to FIG. 1, a high speed measuring and hose cutting apparatus 10 is shown. Three main components of the hose cutting apparatus 10 are a feed conveyor 12, cutter assembly 14 and takeaway conveyor 16 mounted on a main frame 18. The hose cutting apparatus 10 may be stationary with the main frame 18 fastened to the floor or be movable with rollers in engagement with tracks fastened to the floor (not shown).

Figure 4:
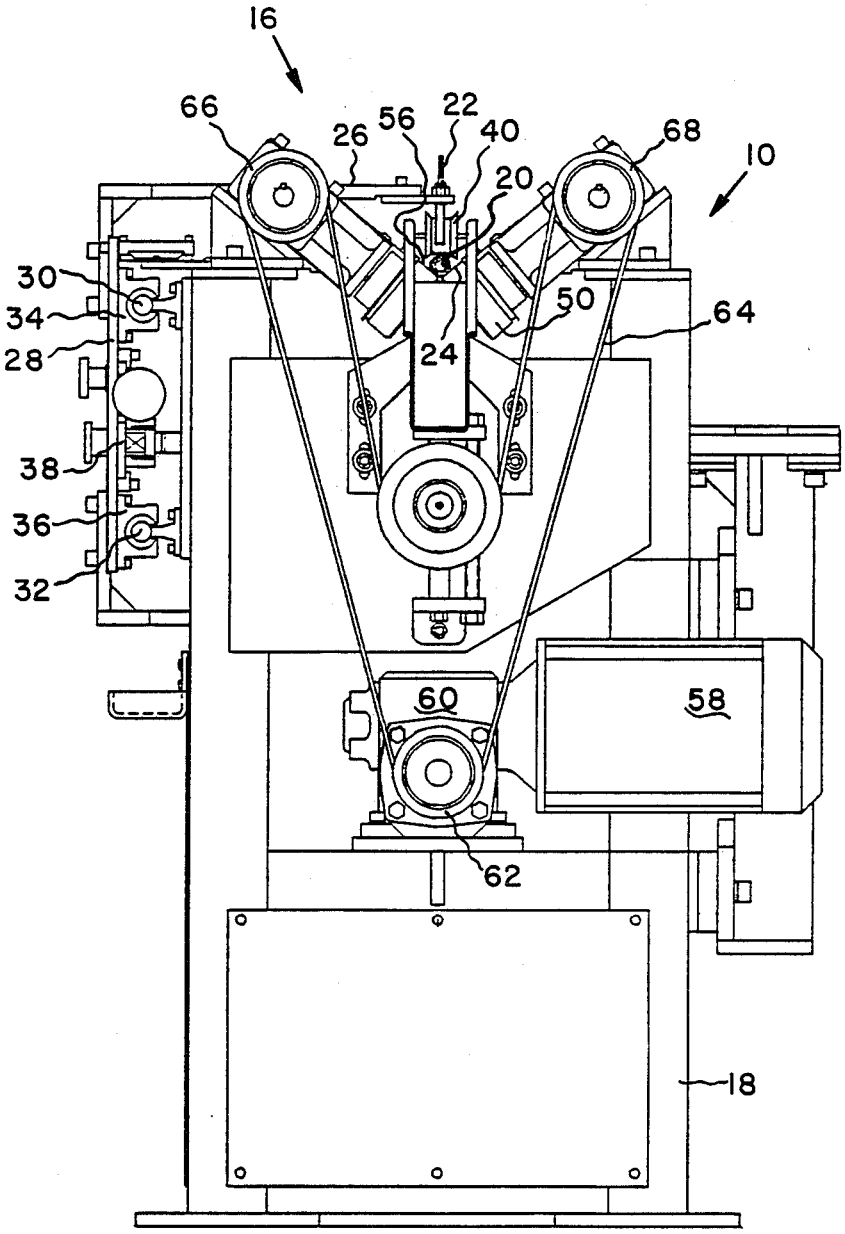
FIG. 4 is an end view of the apparatus taken along line 4—4 in FIG. 1.

The hose cutting apparatus 10 is adapted to cut an elongated member such as a hose 20 to provide a section 21 having a predetermined length such as distance L between the cutter assembly 14 and a first detection means such as a cut photoeye 22 located along the takeaway conveyor 16. The cut photoeye 22 is an optical device positioned over the takeaway conveyor 16 and generates a signal in response to the passage of a leading end 24 of a section 21 past the photoeye. Electronic circuit means may be electrically coupled to and responsive to the photoeye 22 for generating output signals to the cutter assembly 14. As shown in FIGS. 1 and 4, the photoeye 22 is mounted on a support arm 26 fastened to a carriage 28 slidably mounted on tracks 30 and 32 for movement to the desired location along the takeaway conveyor 16. Slides 34 and 36 fastened to the carriage 28 are in sliding engagement with the tracks 30 and 32, respectively. A suitable locking and adjustment means such as adjustment assembly 38 may be provided for setting the carriage 28 in the desired location so that the cut photoeye 22 is at the predetermined distance L from cutter assembly 14.

A hold-down roller 40 may be mounted on the bracket 26 so that when the position of the leading end 24 of the section 21 is measured, the end will be held down to provide the most accurate reading.

A second detection means such as leading end photoeye 42 may be located at a position between the cutter assembly 14 and the cut photoeye 22 and may be mounted on a bracket 44 fastened to the frame 18. A hold-down roller 46 may also be mounted on the bracket 44 to obtain an accurate reading of the leading end of the hose 20.

Figure 5:
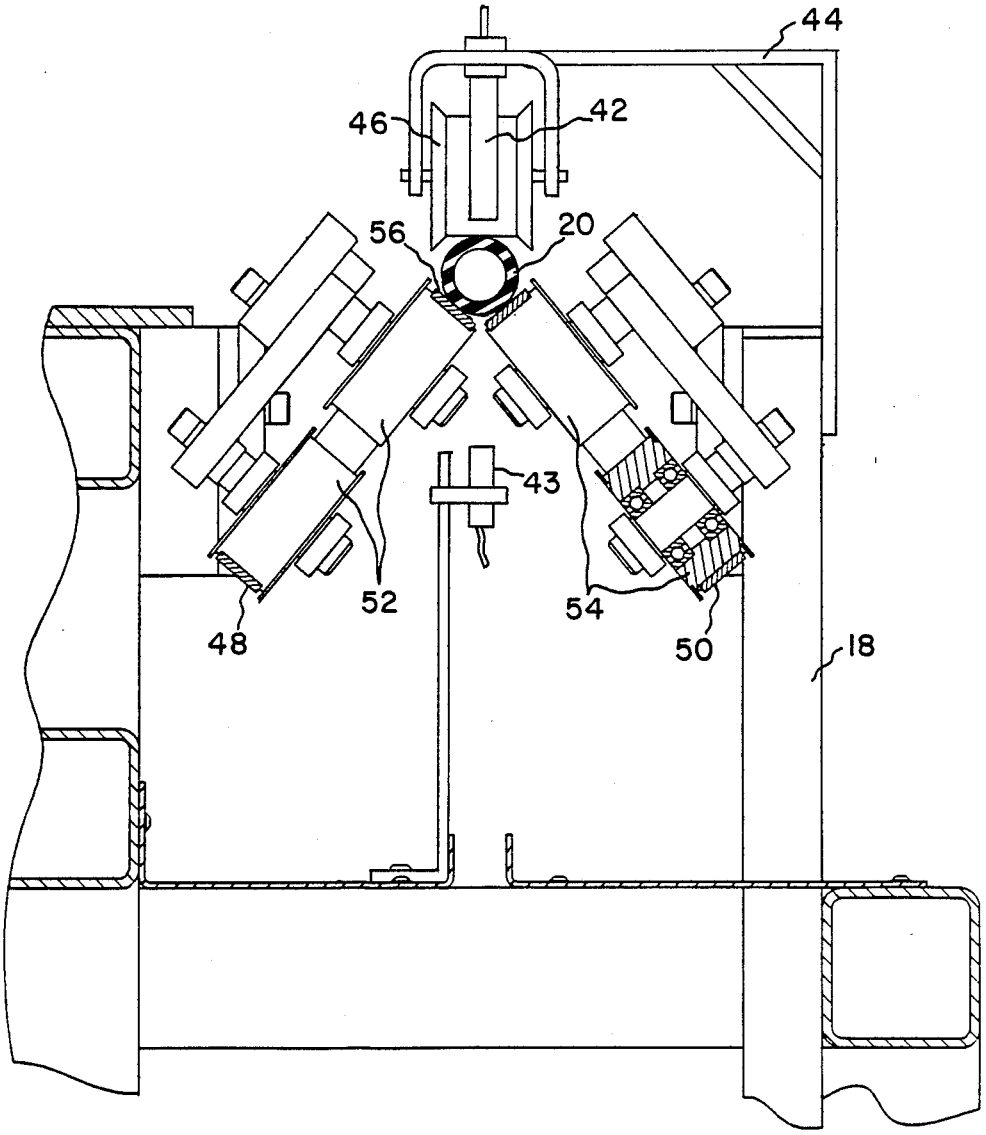
FIG. 5 is an enlarged fragmentary sectional view of the takeaway conveyor taken along line 5—5 in FIG. 1 and with one of the pulleys being sectioned.

As shown in FIGS. 4 and 5, the takeaway conveyor 16 has a pair of belts 48 and 50 mounted on two sets of pulleys 52 and 54, respectively, positioned to provide a trough-shaped passage 56 for the hose 20. The belt 48 is positioned on one side and the belt 50 is positioned on the other side of the hose 20 with the hold-down rollers 40 and 46 positioned between the belts. The takeaway conveyor 16 may be driven by a sychronous motor 58 having a speed reducer 60 driving a pulley 62 connected by a drive belt 64 to driven pulleys 66 and 68 of individual gear train assemblies having drive pulleys for the sets of pulleys 52 and 54.

Figure 2:
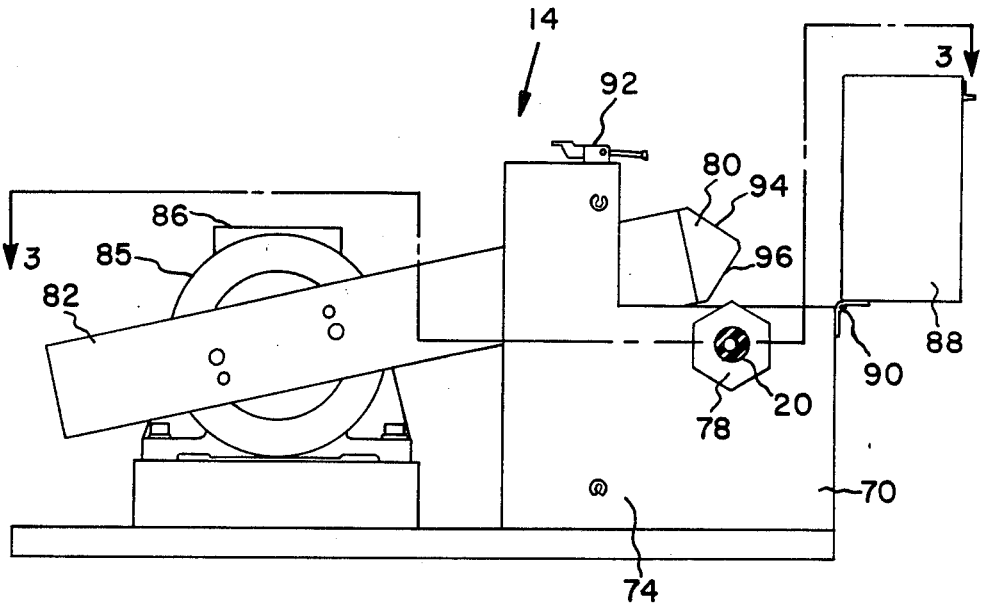
FIG. 2 is an enlarged detailed end elevation of the cutter taken along line 2—2 in FIG. 1 and with the guard lifted to show the knife.
Figure 3:
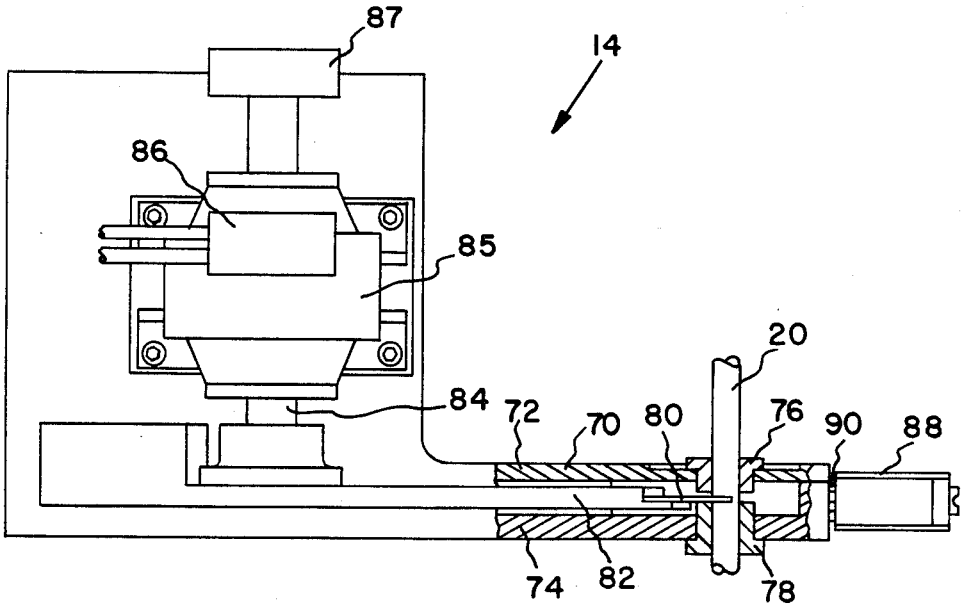
FIG. 3 is a plan view of the cutter shown in FIG. 2 taken along line 3—3 in FIG. 2 with the guard and die holder sectioned and broken away to show the cutter arm.

Referring to FIGS. 2 and 3, the cutter assembly 14 is shown with a housing 70 mounted on the main frame 18 and having opposing walls 72 and 74 supporting dies such as bushings 76 and 78 which have openings of substantially the same diameter as the outer diameter of the hose 20. A cutter means such as knife blade 80 is mounted on a swinging arm 82 for movement between the bushings 76 and 78 in up and down directions to sever the hose 20. The knife arm 82 is mounted on a shaft 84 of a hydraulic rotary cutter actuator 86 which is in communication with a source of hydraulic pressure. The flow of hydraulic pressure to the rotary cutter actuator 85 is controlled by suitable means such as a proportional control valve 86 and a rotary position sensor 87 to precisely locate dwell positions of the knife blade 80. Precisely locating the dwell positions is necessary so that the upper and lower positions of the knife are equidistant from the center of the hose 20, and the knife-cut intervals are the same in both directions to insure cutting of hose sections of the same length. Access to the knife blade 80 is provided by a hinged cover 88 rotatable about a hinge 90 and fastened to the housing by a latch 92.

Where a number of different size hoses are to be cut, the hinged cover 88 may be circular and rotatable about an axis spaced from the hose passage so that a number of different size bushings 76 and 78 may be located around the axis for movement to the desired hose position for the size of the hose. As shown, the knife blade 80 has cutting surfaces 94 and 96 at opposite sides for cutting the hose when the arm 82 is moved in the clockwise direction downward through the hose 20 and in the counterclockwise direction upward through the hose.

Figure 6:
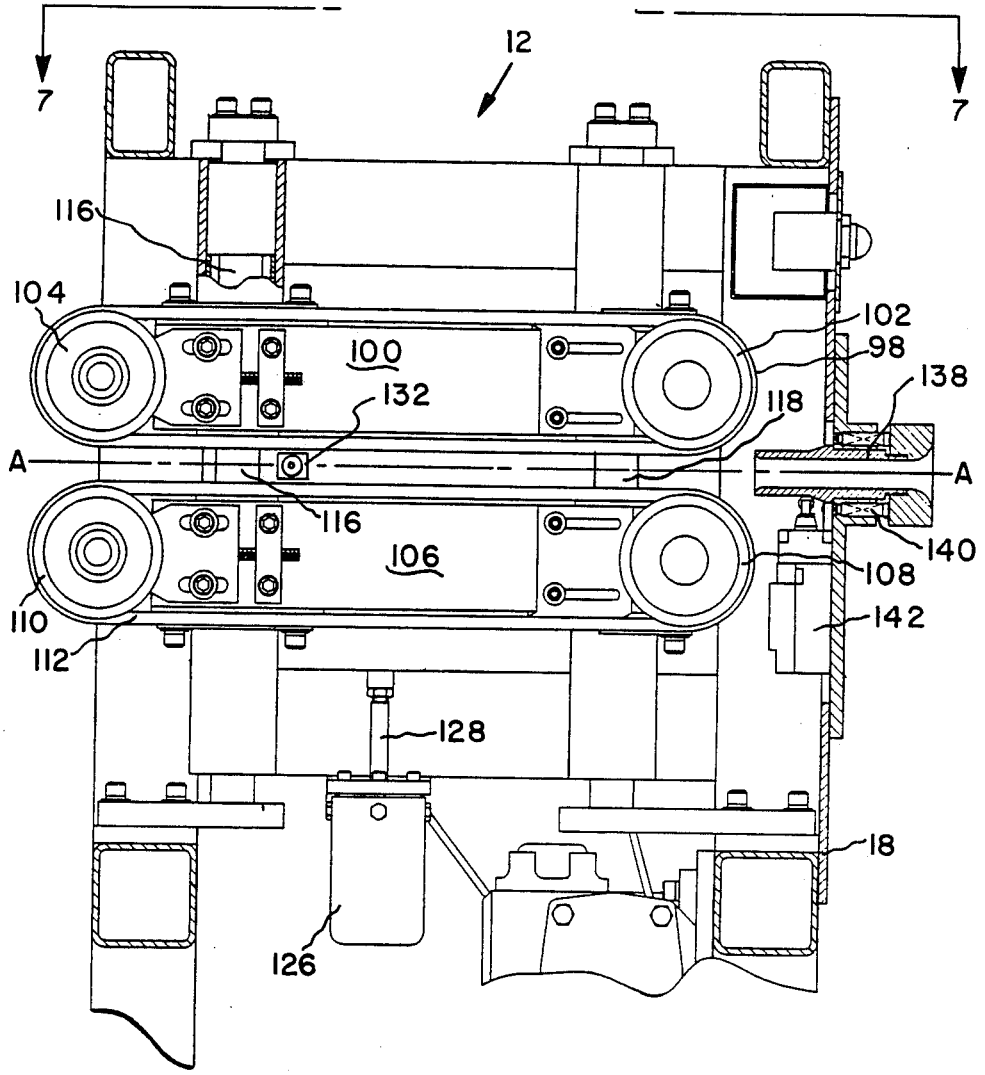
FIG. 6 is a enlarged fragmentary detailed side elevation of the opposite side of the feed conveyor shown in FIG. 1.
Figure 7:
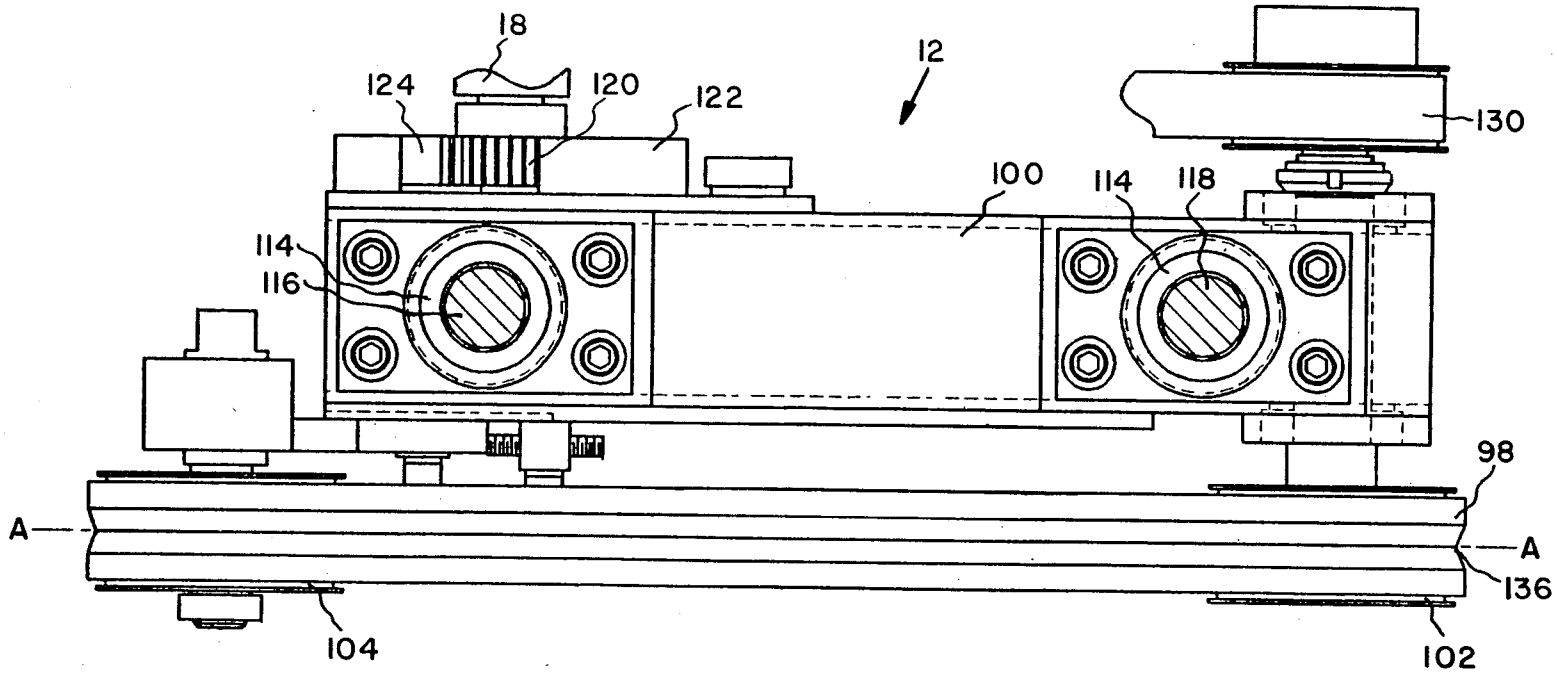
FIG. 7 is a fragmentary plan view of the feed conveyor taken along line 7—7 in FIG. 6.

With reference to FIGS. 6 and 7, the feed conveyor 12 is shown in more detail. An upper belt 98 is mounted on a belt support means such as upper belt beam 100 having a drive pulley 102 and an idler pulley 104. A lower belt beam 106 also has a drive pulley 108 and an idler pulley 110 for supporting a lower belt 112. The upper belt beam 100 and lower belt beam 106 have bushings 114 in sliding engagement with vertical shafts 116 and 118 mounted on the main frame 18 for vertical movement of the beams. As shown in FIG. 7, a pinion 120 is rotatably mounted on the main frame 18 and is engageable with a rack 122 fastened to the upper belt beam 100 and a rack 124 fastened to the lower belt beam 106 so that upon movement of the lower belt beam toward the upper belt beam the two beams will be moved together at the same rate. This will maintain the hose 20 in a centered position along axis A—A of the feed conveyor which is in alignment with the bushings 76 and 78 of the cutter assembly 14. The lower belt beam 106 may be raised or lowered by a single-acting spring return pneumatic cylinder 126 mounted on the main frame 18 and connected to the lower belt beam by a rod 128.

The drive pulleys 102 and 108 may be driven by belts 130 connected to a suitable source of power such as a sychronous motor (not shown) for driving the upper belt 98 and lower belt 112 together at a desired speed.

A third detection means such as trailing end photoeye 132 is positioned at a location along the feed conveyor 12 and is responsive to passage of the trailing end of the hose 20 for stopping the operation of the apparatus 10 when all of the hose has been cut into sections of the desired length. The trailing end photoeye 132 may also be connected to the leading end photoeye 42 to indicate a jamming of the apparatus 10 at the cutter assembly 14 when the leading end photoeye 42 is not actuated by the hose 20 within a predetermined time after the trailing end photoeye 132 is actuated by the hose. In addition jamming is indicated when the leading end photoeye 42 is not actuated by the hose 20 within a predetermined time after each cut. These signals are transmitted to suitable controls for stopping the apparatus 10 when jamming takes place.

In operation, the operator feeds the leading end 24 of the hose 20 into the feed conveyor 12 which is being driven at a predetermined first speed of around 150 feet per minute (45.72 meters per minute). The hose 20 is fed through the cutter assembly 14 and onto the takeaway conveyor 16. When the leading end 24 passes the leading end photoeye 42, signals are transmitted to the proportional control valve 86 and rotary position sensor 87 of the cutter assembly 14 so that the rotary cutter actuator 85 is actuated to swing the knife arm 82 either in the upward or downward direction. The blade 80 will then press the cutting edges 94 or 96 through the hose 20 and cut off the first section 21 providing a clean cut leading end of a second section. Cutting off a short first section 21 is usually necessary because the leading end 24 of the first section may be damaged or deformed in the molding process. This cutoff first section 21 may be scrapped or used for some other purpose where a clean cut leading end is not essential. A gap between the leading end of the second section and the trailing end of the first section 21 is formed and the leading end of the second section is carried to the location of the cut photoeye 22 which generates a signal in response to the passage of the leading end which is transmitted to the proportional control valve 86 and rotary position sensor 87 to control the rotary cutter actuator 86 of the cutter assembly 14. The arm 82 is then swung in the opposite direction causing the blade 80 to press the other one of the cutting edges 94 or 96 through the hose 20 providing a second section of the desired predetermined length L which is transmitted with the first section to a chute 134 for conveying the sections to a suitable container or conveyor.

In order for the cut photoeye 22 to function, a gap must be provided between the trailing end of the first section 21 and the leading end of the second section. This may be provided by various means; however, in this embodiment, the takeaway conveyor 16 is driven at a higher speed than the speed the feed conveyor 12 is driven which provides the necessary gap or space. The speed of the takeaway conveyor 16 is 180 feet per minute (54.9 meters per minute) and the speed of the feed conveyor 12 is 150 feet per minute (45.7 meters per minute).

With the apparatus of this embodiment, the cut photoeye 22 may be connected to a timer for measuring the time intervals between actuation of the cutting assembly 14 in response to signals from the cut photoeye 22. The time intervals between the cutting of the second, third, fourth, fifth and following sections may then be compared by suitable control means. When the time intervals vary over a predetermined amount, indicating a malfunction of the apparatus, the control may be programmed to stop the apparatus 10 and thereby reduce the scrap loss.

It has been found that with the apparatus 10 of this invention, it is not necessary to stop the feed conveyor 12 or takeaway conveyor 16 during the cutting operation of the hose 20. Although the hose 20 is stopped at the portion being cut while the knife blade 80 passes through the hose 20, the movement of the knife is at such a speed that it is not necessary to stop the conveyors. For example, the total cutting time is about 0.045 seconds with a peak blade speed of 191 rpm. This is provided with a hydraulic rotary cutter actuator 85 having a peak oil flow of 10 gallons per minute with a system pressure of 2,000 pounds per square inch (140.62 $kg/cm^2$). The inertia of the blade arm 82 is about 0.8 in-lb-$sec^2$ (4.48 cm-kg-$sec^2$) and the actuator torque is about 1,720 in-lb (9623 cm-kg) at 1,000 psi (70.31 $kg/cm^2$). The total stroke of the arm 82 is about 24 degrees.

As shown in FIG. 7, the upper belt 98 and the lower belt 112 of the feed conveyor 12 may be grooved to provide a V-shaped though 136 for gripping the hose 20 and maintaining it in position along the axis A—A of the feed conveyor 12. The feed conveyor 12 may also have a guide tube 138 at the entrance end for guiding the hose into the feed conveyor 12. The guide tube 138 may be mounted with springs 140 holding the tube away from the side of the frame 18. Then if the hose 20 jams in the tube 138, it will be moved and actuate a switch 142 which will stop the hose cutting apparatus 10.

With this apparatus 10, the length L of the cut sections may be adjusted by moving the carriage 28 to a desired position along the takeaway conveyor 16 so that the distance between the cutter blade 80 at the cutter assembly 14 and the cut photoeye 22 is equal to the predetermined desired length of the sections to be cut. This length may be between 4.7 and 77 inches (11.9 and 196 cm) with a tolerance plus or minus 0.030 inches (0.076 cm). Also with the bushings 76 and 78 in the walls 72 and 74 of the cutter assembly housing 70, the cut of the knife 80 is within one degree of perpendicular to the length of the hose 20 at a line speed of about 150 feet per minute (45.72 meters per minute). The shortest lengths L of the cut sections require over six cuts per second.

The type of photoeyes which are used for the cut photoeye 22, leading end photoeye 42 and trailing end photoeye 132 may be of a miniature through beam pair with an effective beam diameter of 0.060 inches (0.15 cm).

While a certain representative embodiment and details have been shown for the purpose of illustrating the invention, it will be apparent to those skilled in the art that various changes and modifications may be made therein without departing from the spirit or scope of the invention.

What is claimed is:

1. A high speed measuring and cutting apparatus for cutting a flexible hose of predetermined diameter to provide a cut section having a predetermined length comprising a feed conveyor, cutter means, said cutter means comprises a pair of dies in side by side relation, each of said dies having an opening of substantially the same diameter as said predetermined diameter of said hose, each of said dies circumferentially supporting said hose, said cutter means further comprises a knife member moveable between said pair of dies, said knife member being mounted for cutting movement in two directions, said cutter means further comprises a cutter actuation means for moving said knife member in said two directions, a takeaway conveyor, means for continuously driving said feed conveyor at a constant speed for feeding said hose through said cutter means, means for continuously driving said takeaway conveyor at a constant speed greater than the constant speed said feed conveyor is driven to convey said hose away from said cutter means after a first section is cut and provide a gap between a trailing end of said first section of said hose and a leading end of a second section of said hose, first detection means spaced from said cutter means a distance equal to said predetermined length and said cutter actuation means being responsive to detection of movement of said leading end of said second section past said detection means for actuating said cutter actuation means to cut said second section to said predetermined length during said continuous driving of said feed conveyor and said takeaway conveyor.

2. Apparatus according to claim 1 including a second detection means positioned at a location between said cutter means and said first detection means, and said cutter actuation means being responsive to detection of said leading end of said hose past said second detection means for actuating said cutter means to initially cut off said first section at a length less than said predetermined distance.

3. Apparatus according to claim 1 wherein said feed conveyor comprises an upper belt, a lower belt, belt support means for moving said upper belt and said lower belt together to press said upper belt and said lower belt against said hose and said means for driving said feed conveyor driving said upper belt and said lower belt at the same speed.

4. Apparatus according to claim 1 including a third detection means positioned at a location along said feed conveyor and being responsive to detection of the trailing end of said elongated member past said third detection means for generating signals to said cutter means and the said driving means for said feed conveyor and said takeaway conveyor to stop the operation of said apparatus when the trailing end of said hose passes by said third detection means before the leading end of said second section passes by said first detection means.

5. Apparatus according to claim 1 wherein said knife member is mounted on an arm pivotally supported for swinging in said two directions between upper and lower positions, and said cutter actuation means includes a hydraulic rotary cutter actuator in communication with a source of hydraulic fluid under pressure.

6. Apparatus according to claim 5 wherein said cutter actuation means further comprises a proportional control valve and a rotary position sensor for controlling the flow of hydraulic fluid to said rotary cutter actuator to precisely locate dwell positions of said knife member so that said upper and lower positions of said knife member are equidistant from the center of said hose and each said cut section will be of the same length.

7. Apparatus according to claim 1 wherein said takeaway conveyor includes a pair of belts positioned to provide a trough-shaped passage for said hose with one of said pair of belts on each side of said hose and hold-down rollers positioned between said pair of belts for continuously holding said hose against both of said pair of belts at said detection means.

8. Apparatus according to claim 1 wherein said detection means includes optical means positioned adjacent said takeaway conveyor and generating a signal in response to the passage of said leading end of said second section past said optical means, an electronic circuit means electrically coupled to and responsive to said optical means for generating output signals to said cutter actuation means.

9. A method of measuring and cutting a flexible hose of predetermined diameter to provide a section having a predetermined length comprising:

(a) continuously feeding said hose at a constant speed through a cutter means on a feed conveyor, detecting a leading edge of a first section of said hose by a second detection means located at a position between said cutter means and a first detection means, and actuating said cutter means in response to the detection of movement of said leading edge of said hose past said second detection means to cut said first section into a length less than said predetermined length;

(b) actuating said cutter means to cut said first section off said hose;

(c) continuously conveying said first section of said hose at a constant speed greater than the constant speed said hose is fed on said feed conveyor away from said cutter means on a takeaway conveyor providing a gap between a trailing end of said first section and a leading end of a second section of said hose;

(d) detecting said leading end of said second section by said first detection means located at a distance from said cutter means equal to said predetermined length; and (e) actuating said cutter means in response to the detection of movement of said leading end of said second section by said first detection means to cut said section to said predetermined length during said continuous feeding and conveying.

10. The method of claim 9 further comprising detecting said trailing end of said hose by a third detection means located at a position along said feed conveyor and stopping said cutter means, said feed conveyor and said takeaway conveyor in response to movement of said trailing end past said third detection means.

11. The method of claim 10 further comprising the step of stopping the operation of said feed conveyor and said takeaway conveyor when said second detection means does not detect the presence of the leading end of said hose in said takeaway conveyor within a predetermined time after said third detection means indicates the presence of the leading end of said hose in said feed conveyor.

12. The method of claim 9 wherein said first section is cut to said predetermined length in response to detecting the leading end of said first section by said detection means and third, fourth and fifth sections are cut to said predetermined length in response to detecting the leading ends of said sections by said detection means further including the step of measuring the time intervals between the actuation of said cutter means and comparing said time intervals and stopping said feed conveyor and said takeaway conveyor in response to a variation in said time intervals over a predetermined amount indicating a malfunction of said apparatus.

* * * * *